US007048489B2

(12) United States Patent
Sugaya et al.

(10) Patent No.: US 7,048,489 B2
(45) **Date of Patent: *May 23, 2006**

(54) PACKAGE TAKE-OUT APPARATUS, PACKAGE CONTAINER THEREOF AND UNWRAPPING APPARATUS

(75) Inventors: Fumio Sugaya, Kanagawa-ken (JP); Yoichi Endo, Kanagawa-ken (JP); Akihiro Komatsu, Kanagawa-ken (JP); Tomoyuki Takiue, Kanagawa-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 221 days.

This patent is subject to a terminal disclaimer.

(21) Appl. No.: 10/459,569

(22) Filed: Jun. 12, 2003

(65) Prior Publication Data

US 2003/0198546 A1 Oct. 23, 2003

Related U.S. Application Data

(62) Division of application No. 09/810,460, filed on Mar. 19, 2001, now Pat. No. 6,705,818.

(30) Foreign Application Priority Data

Mar. 17, 2000 (JP) ..... 2000/076624
Mar. 27, 2000 (JP) ..... 2000/086642

(51) Int. Cl.
*B67B 7/68* (2006.01)

(52) U.S. Cl. ..... 414/412; 414/411; 53/381

(58) Field of Classification Search ..... 414/412, 414/411, 403; 53/381; 271/225
See application file for complete search history.

(56) References Cited

U.S. PATENT DOCUMENTS

| | | | | |
|---|---|---|---|---|
| 3,156,378 | A | 11/1964 | Bua | |
| 3,450,308 | A | 6/1969 | Schoenfeld | |
| 3,639,059 | A | 2/1972 | Strumor et al. | |
| 4,158,412 | A | 6/1979 | Wysocki | |
| 4,405,044 | A | 9/1983 | Flower et al. | |
| 4,571,140 | A * | 2/1986 | Yamada et al. | 414/412 |
| 4,900,007 | A * | 2/1990 | Gammerler | 271/185 |
| 5,055,869 | A * | 10/1991 | DiPietro | 396/517 |
| 5,240,139 | A | 8/1993 | Chirnomas | |
| 5,538,688 | A | 7/1996 | Tezuka et al. | |
| 5,642,837 | A | 7/1997 | Hayes et al. | |

(Continued)

FOREIGN PATENT DOCUMENTS

JP 9-237383 9/1997

*Primary Examiner*—Eileen D. Lillis
*Assistant Examiner*—Charles A. Fox
(74) *Attorney, Agent, or Firm*—Sughrue Mion, PLLC

(57) ABSTRACT

A slide pack container housing a plurality of piled slide packs has a cut-off portion. The cut-off portion has a width slightly larger than the width of a slide contained in each slide pack. As a sucker of a package take-out apparatus draws one of the slide packs from the slide pack container through the cut-off portion, a sealed portion of the slide pack interfering with the edge of the cut-off portion is folded inward so that the slide pack is successfully taken out. The sucker transfers the slide pack to a separated unwrapping apparatus. The sucker releases the slide pack when the front edge of the slide pack is caught between paired rollers of the unwrapping apparatus. After a cutter makes a slit on the slide pack, the paired rollers transfer only a wrapping sheet to separate the wrapping sheet from the slide wrapped therewith.

9 Claims, 21 Drawing Sheets

U.S. PATENT DOCUMENTS 5,673,814 A 10/1997 Terashima et al.
5,971,205 A 10/1999 Michaels et al.
6,431,813 B1 * 8/2002 Sugaya et al. ..... 414/412
6,468,801 B1 10/2002 Seto et al.

* cited by examiner

PACKAGE TAKE-OUT APPARATUS, PACKAGE CONTAINER THEREOF AND UNWRAPPING APPARATUS

This is a divisional of application Ser. No. 09/810,460 filed Mar. 19, 2001 now U.S. Pat. No. 6,705,818; the disclosure of which is incorporated herein by reference.

BACKGROUND OF THE INVENTION

1. Field of the Invention

The present invention relates to a package take-out apparatus for taking out individual packages piled and housed in a package container, and to the package container itself. The present invention also relates to an unwrapping apparatus for unwrapping a package wrapped with a wrapping sheet to obtain a solid object wrapped therein.

2. Description of the Related Art

Heretofore, there has been a widely used dry-type slide for chemical analysis (hereinafter, referred to simply as a "slide"). Such a slide may be used for quantitative analysis of a chemical component or a material component of a liquid sample dripped thereon. More specifically, the quantitative analysis may be carried out by dripping a drop of a liquid sample on the slide, putting the slide in an incubator for a predetermined time to promote color reaction (i.e., color matter producing reaction) of the liquid sample, irradiating the slide with radiation including a predetermined wavelength to measure optical density of a target biochemical substance contained in the liquid sample, and determining physical density of the target biochemical substance based on the measured optical density referring to a predetermined working curve correlating the optical density of the biochemical substance with the physical density thereof. The predetermined wavelength included in the radiation is determined depending on the combination of the target biochemical substance contained in the liquid sample and a reagent mixed in a material of the slide. The entire process described above is carried out by a suitably configured biochemical analyzer.

The biochemical analyzer used for the above quantitative analysis has a slide stocking portion which holds a plurality of slides ready for the analysis. Usually, when shipping the slides, each slide is wrapped tightly with a plastic film laminated with a metal lamina or a plurality of slides are packed in a single tightly-wrapped cartridge. In each case, an unwrapped slide must be used immediately or stocked in a dry atmosphere, as the reagent mixed in the material of the slide deteriorates rapidly. Therefore, it is desirable to use a plurality of individually-wrapped slides when there is a need to analyze many slides.

Usually, about ten to fifty slides wrapped individually (hereinafter, referred to as "slide packs") are housed in a container before being shipped to an examiner. The examiner needs to take each slide pack out of the container immediately before using it, leaving the rest of the slide packs in the container for storage. However, preparation for the analysis will require a lot of effort if the examiner has to manually take out and unwrap each slide pack one by one.

To reduce the problem, there have been several known apparatuses for unwrapping a package wrapped with a wrapping sheet such as a wrapping film to obtain a solid object wrapped therein. One example of such apparatuses is disclosed in Japanese Unexamined Patent Publication No. 9(1997)-237383. The apparatus disclosed in the Publication is directed to unwrapping a belt-like package containing a series of sub-packs each containing beverage ingredients therein. The sub-packs are tightly sandwiched between an upper wrapping sheet and a lower wrapping sheet. Although the disclosed apparatus is capable of unwrapping the belt-like package by peeling the upper wrapping sheet off from the lower wrapping sheet to obtain the sub-packs therein, the examiner is still required to manually detach edges of the upper and lower wrapping sheets in advance. Thus, the disclosed apparatus is incapable of unwrapping the individually wrapped slides in a completely automated manner.

SUMMARY OF THE INVENTION

An object of the present invention is to provide a package take-out apparatus for taking out of a package container individual packages each containing a solid object, such as the slide described above wrapped with a wrapping sheet. Another object of the present invention is to provide a package container suitable for use in the above package take-out apparatus.

Still another object of the present invention is to provide an unwrapping apparatus capable of automatically unwrapping the package containing the solid object wrapped with the wrapping sheet.

According to the first aspect of the present invention, there is provided a package take-out apparatus for taking out individual packages, each containing a solid object tightly wrapped with a wrapping sheet, piled and housed in a package container, each of the packages including an unsealed space where the solid object is contained and a sealed portion surrounding the unsealed space, comprising: housing means for housing the package container, the package container having a cut-off portion on the top face or the bottom face thereof, wherein the width of the cut-off portion is slightly larger than the width of the solid object contained in each of the packages; sucker means for sucking the package to take the package out of the package container through the cut-off portion; sucker moving means for moving the sucker means; and controlling means for controlling operations of the sucker means and the sucker controlling means by causing the sucker moving means to move the sucker means to a position near the cut-off portion of the package container, causing the sucker means to suck the package, and moving the sucker means to take the package out of the package container through the cut-off portion.

The position of the solid object may be shifted within the unsealed space of the package. However, the above width of the cut-off portion, which is only slightly larger than the width of the solid object, prevents the package from falling out of the package container wherever the solid object is located within the unsealed space of the package. The package never falls out of the package container unless the sucker means forcedly draws the package from the package container through the cut-off portion.

The above package take-out apparatus according to the first aspect of the present invention saves the examiner effort of taking each package out of the package container one by one in a manual manner, as the sucker means in the package take-out apparatus automatically takes each package out of the package container. As the width of the cut-off portion of the package container is only slightly larger than the width of the solid object in the package, the sealed portion of the package interfering with the edge of the cut-off portion is folded inward when the sucker means draws the package from the package container. Concurrently, the solid object moves substantially to the center of the package within the unsealed space thereof. As the folded sealed portion of the package helps a separated unwrapping apparatus catch the package firmly and easily, the package take-out apparatus according to the first aspect of the present invention also improves efficiency of an unwrapping operation carried out after the taking-out operation.

In addition, as package never fall out of the package container unless the sucker means forcedly draws the package from the package container through the cut-off portion, the examiner may easily carry and handle the package container.

It is desirable that the above package take-out apparatus according to the first aspect of the present invention further comprises: selecting means for selecting one package container from a plurality of given package containers; wherein the housing means is capable of housing said plurality of package containers arranged in a predetermined manner; and wherein the controlling means further controls operations of the sucker moving means by causing the sucker moving means to move the sucker means to a position near the cut-off portion of said one package container selected by the selecting means. Using such a package take-out apparatus provided with the selecting means, the examiner may take out a plurality of packages, which contains different solid objects, in a desired order by specifying different package containers arranged on the housing means according to the desired order.

In addition, it is desirable that the controlling means in the above package take-out apparatus further controls operations of the sucker moving means by causing the sucker moving means to transfer the package taken out by the sucker means to a separated unwrapping apparatus. In this case, efficiency of the entire operation is improved as the taking-out operation and the subsequent unwrapping operation are carried out in sequence.

Further, it is desirable that the package container in the above package take-out apparatus is provided with a perforation line enabling the cut-off portion to be opened by peeling off a portion of the package container along the perforation line. Such a structure of the package container further prevents the packages therein from falling out of the package container during shipping etc.

In addition, it is desirable that the package container in the above package take-out apparatus is provided with another cut-off portion enabling observation of an inner area of the package container. This cut-off portion enables the examiner to check the rest number of the packages contained in the package container. This cut-off portion is preferably opened in the similar manner as described above by peeling off a portion of the package container along another perforation line. Again, such a structure further prevents the packages therein from falling out of the package container during shipping etc.

According to the second aspect of the present invention, there is provided a package container for housing in a piled fashion a plurality of packages each containing a solid object tightly wrapped with a wrapping sheet, each of the package including an unsealed space where the solid object is contained and a sealed portion surrounding the unsealed space, comprising: a cut-off portion on the top face or the bottom face thereof; wherein the width of the cut-off portion is slightly larger than the width of the solid object contained in each of the packages.

It is desirable that the above package container according to the second aspect of the present invention further comprises a perforation line enabling the cut-off portion to be opened by peeling off a portion of the package container along the perforation line.

In addition, it is desirable that the above package container according to the second aspect of the present invention further comprises another cut-off portion enabling observation of an inner area of the package container. This cut-off portion is preferably opened in the similar manner as described above by peeling off a portion of the package container along another perforation line.

According to the third aspect of the present invention, there is provided an unwrapping apparatus for unwrapping a package containing a solid object tightly wrapped with a wrapping sheet, the package including an unsealed space where the solid object is contained and a sealed portion surrounding the unsealed space, comprising: paired rollers rotatable so that the package caught between the paired rollers is transferred along a predetermined transferring path; displacing means for displacing the paired rollers so that the wrapping sheet of the package caught between the paired rollers is transferred along another path different from the predetermined transferring path; a cutter located in front of the paired rollers along the predetermined transferring path for making a slit on the unsealed space at a position near the front edge of the package; and controlling means for controlling operations of the paired rollers, the displacing means and the cutter by rotating the paired rollers in respective predetermined directions, suspending rotation of the paired rollers when the front edge of the package is caught between the paired rollers, causing the cutter to make the slit on the package, causing the displacing means to displace the paired rollers, and rotating the paired rollers in the predetermined directions so that only the wrapping sheet separated from the solid object is transferred along said another path different from the predetermined transferring path.

The term "the front edge of the package" refers to the edge at the head of the package while being forwarded along the predetermined transferring path by the paired rollers rotating in the above predetermined directions.

When using the above unwrapping apparatus according to the third aspect of the present invention, the rotation of the paired rollers is suspended when the front edge of the package is caught between the paired rollers. The paired rollers catching the front edge of the package are displaced after the slit is formed on the package. Then, the rotation of the paired rollers is restarted. As the solid object within the package is too thick and rigid to be held and transferred between the paired rollers, only the wrapping sheet is transferred along another path to form splits on the wrapping sheet at both ends of the slit. A portion of the wrapping sheet defined by the splits is gradually peeled off from the solid object as the paired rollers further transfer the wrapping sheet. Finally, the wrapping sheet will be separated from the solid object. That is to say, the above unwrapping apparatus according to the third aspect of the present invention automatically unwraps the package to separate the solid object therein from the wrapping sheet. Further, as the package is cut in a slit-like form (i.e., in a form covering only a partial width of the package) to prevent the wrapping sheet from splitting in two, the removed wrapping sheet to be discarded can be handled easily. In addition, as the wrapping sheet separated from the solid object is pressed between the paired rollers, the bulk of the removed wrapping sheet is reduced to further facilitate handling thereof.

It is desirable that the above unwrapping apparatus according to the third aspect of the present invention further comprises shift detecting means for recognizing that the solid object has been sufficiently squeezed back to the rear end of the unsealed space in the package; wherein the controlling means further controls operations of the paired rollers and the shift detecting means by rotating the paired rollers in the predetermined directions, letting the paired rollers forward the package along the predetermined transferring path until the shift detecting means recognizes that the solid object has been sufficiently squeezed back to the rear end of the unsealed space, rotating the paired rollers in the directions reverse to the predetermined directions to transfer back the package, and suspending rotation of the paired rollers when the front edge of the package is caught between the paired rollers.

In the above case where the unwrapping apparatus further comprises the shift detecting means, the solid object is squeezed back to the rear end of the unsealed space before the operation of the paired rollers is suspended. Accordingly, a relatively wide cut allowance can be obtained at the front edge of the package. Therefore, the unwrapping apparatus with the shift detecting means realizes a safer and easier cutting operation.

In addition, it is desirable that the above unwrapping apparatus according to the third aspect of the present invention further comprises a squeezing member located in front of the paired rollers along the predetermined transferring path in such a manner that the squeezing member can be freely inserted into and retracted from the predetermined transferring path; wherein the controlling means further controls operations of the squeezing member by inserting the squeezing member into the predetermined transferring path before forwarding the package along the predetermined transferring path, and retracting the squeezing member from the predetermined transferring path when the shift detecting means recognizes that the solid object has been sufficiently squeezed back to the rear end of the unsealed space in the package. In this case, the dedicated squeezing member located in front of the paired rollers squeezes the solid object backward as the paired rollers forward the package along the predetermined transferring path. The solid object can be reliably squeezed back to the rear end of the unsealed space to form a wide cut allowance at the front edge of the package, even if the solid object is relatively thin, by using a suitably structured squeezing member.

Further, it is desirable that the above unwrapping apparatus according to the third aspect of the present invention further comprises edge detecting means for detecting the front edge of the package located in front of the paired rollers along the predetermined transferring path; wherein the controlling means further controls operations of the paired rollers by causing the paired rollers to begin the rotation in the predetermined directions after the front edge of the package is detected by the edge detecting means. Such a configuration is effective in reducing power consumption, as the rotation of the paired rollers is activated after the edge detecting means detects the front edge of the package and is suspended during the cutting operation.

In addition, it is desirable that the above unwrapping apparatus according to the third aspect of the present invention further comprises an object cartridge which is used for housing the solid object after being separated from the wrapping sheet and which is located behind the paired rollers along the predetermined transferring path. Such an object cartridge facilitates handling of the unwrapped solid object. The use of the object cartridge is especially effective when the solid object is a slide for chemical analysis as described above, as a plurality of unwrapped slides may be housed in a desired order in the object cartridge to be mounted directly on a biochemical analyzer.

Further, it is desirable that the above unwrapping apparatus according to the third aspect of the present invention further comprises a disposal bin which is used for temporarily storing the wrapping sheet removed from the solid object and which is located below the end of said another path. Such a disposal bin facilitates handling of the removed wrapping sheet to be discarded.

DESCRIPTION OF THE PREFERRED EMBODIMENTS

Now, specific embodiments of the present invention will be described with reference to the accompanying drawings.

Figure 1:
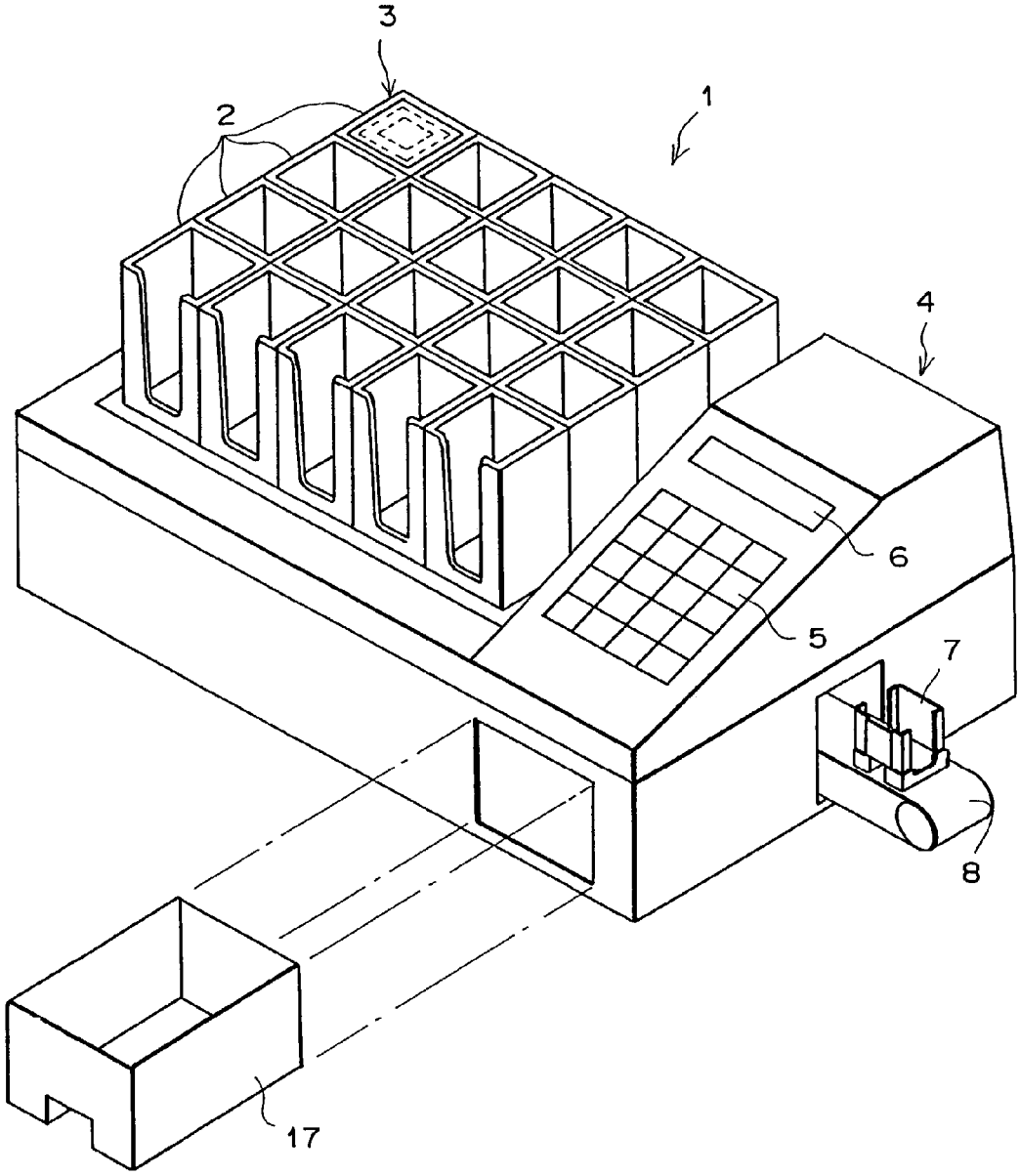
FIG. 1 is a perspective view of a selective unwrapping apparatus including a package take-out apparatus and an unwrapping apparatus according to the first embodiment of the present invention.
Figure 2:
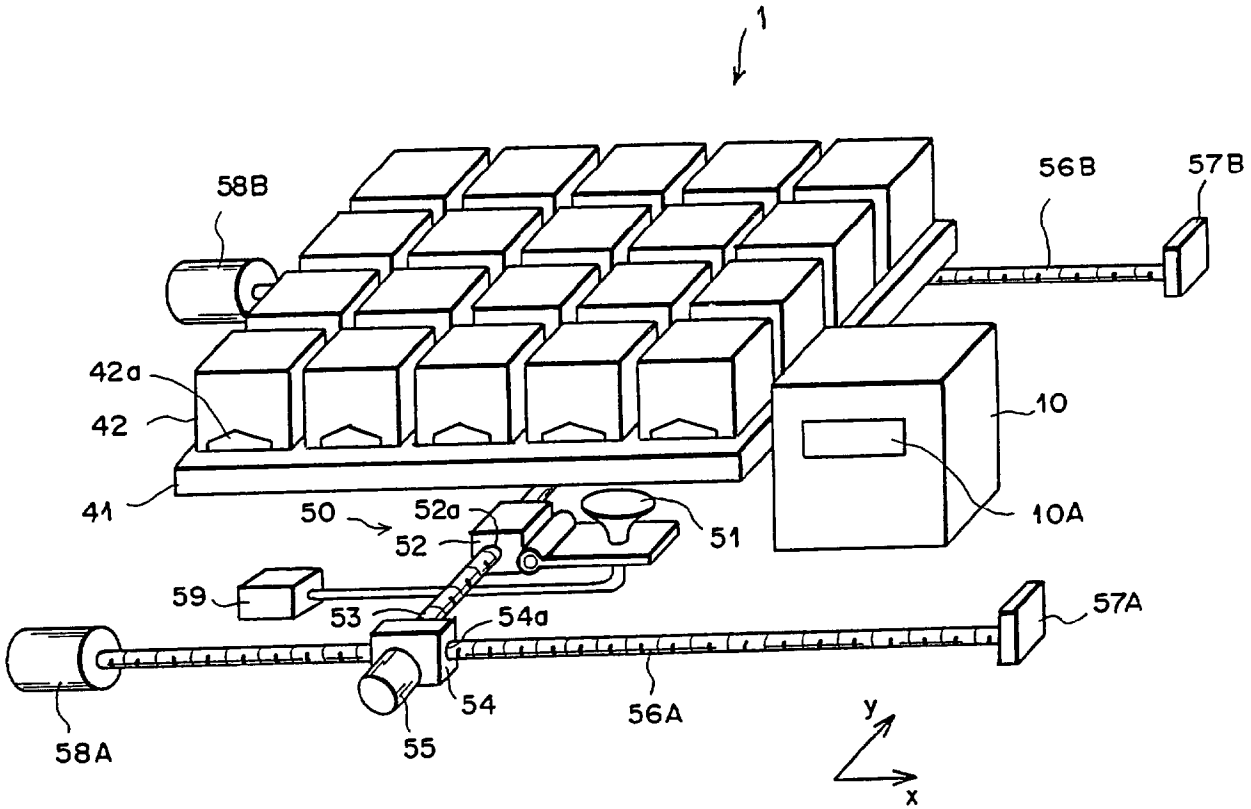
FIG. 2 is another perspective view showing an internal structure of the selective unwrapping apparatus shown in FIG. 1.

FIG. 1 is a perspective view of a selective unwrapping apparatus including a package take-out apparatus and an unwrapping apparatus according to the first embodiment of the present invention, and FIG. 2 is another perspective view showing an internal structure of the selective unwrapping apparatus shown in FIG. 1. The selective unwrapping apparatus 1 is directed to selecting and unwrapping a slide pack containing a dry-type slide used for chemical analysis carried out using a biochemical analyzer. In the present embodiment, the selective unwrapping apparatus comprises a housing portion 3 including a plurality of package cartridges 2 each provided for stocking slide packs each corresponding to certain analysis, and an interface 4 for inputting a command on selection of the slide packs. The interface 4 includes command keys 5 for inputting the command and a display portion 6 for displaying the content of the command for confirmation. An unwrapping apparatus 10 according to the present embodiment is provided in an internal area below the interface 4. A conveyer belt 8 is extended from the vicinity of the unwrapping apparatus 10, wherein the conveyer belt 8 is driven by a motor not shown in the Figures. The conveyer belt 8 provided within the selective unwrapping apparatus 1 carries a cartridge 7 for housing in a desired order a plurality of slides obtained from the slide packs unwrapped by the unwrapping apparatus 10. Also provided in the internal area below the interface 4 is a disposal bin 17 used for temporarily storing the wrapping sheet removed from the slide. The disposal bin 17 can be freely removed from and re-attached to the selective unwrapping apparatus 1. The slide pack is fed to the unwrapping apparatus 10 through an opening 10A thereon.

Figure 3:
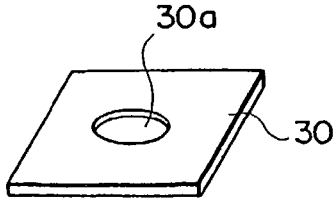
FIG. 3 is a perspective view of a slide contained in a slide pack to be unwrapped by the unwrapping apparatus.
Figure 4A:
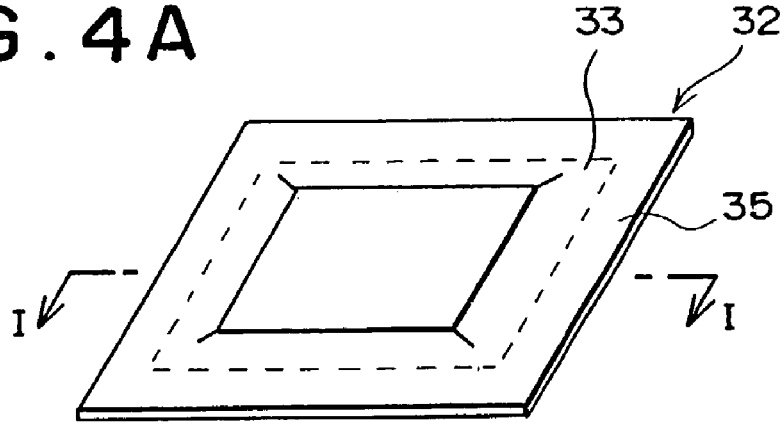
FIGS. 4A and 4B show the structure of the slide pack to be unwrapped by the unwrapping apparatus.
Figure 4B:
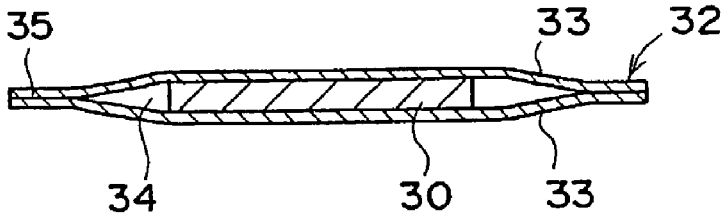

FIG. 3 is a perspective view of a slide contained in the slide pack to be unwrapped by the unwrapping apparatus 10. FIG. 4A is a perspective view of the slide pack before being unwrapped, and FIG. 4B is a sectional view thereof along the line I—I in FIG. 4A. As shown in FIG. 3, the slide 30 has a mount of a rectangular shape, and a dripping hole 30*a* is opened on the rectangular mount. In the present embodiment, blood plasma is dripped into the dripping hole 30*a* for analysis. In addition, a bar code is provided on the opposite side of the slide 30 for identifying the content of the analysis etc. related with that slide 30. Preferable dimensions for the slide 30 are 24 mm in width, 28 mm in length and 1.4 mm in thickness. The slide pack 32 shown in FIGS. 4A and 4B is prepared by sandwiching the slide 30 with a pair of wrapping sheets 33 (e.g., plastic films each laminated with a metal lamina), and forming a sealed portion 35 around an unsealed space 34 while securing the enough unsealed space 34. In such a manner, the slide 30 is wrapped tightly with the wrapping sheets 33. In the case where the plastic film having the thickness of 0.05 mm is used as the wrapping sheet 33 together with the slide 30 having the above dimensions, dimensions of the slide pack 32 may be 46 mm in width and 50 mm in length. Then, a plurality of slide packs 32 are packed together in a slide pack container 42 before being shipped to the examiner. Each of the package cartridges 2 in the present embodiment is capable of housing all slide packs 32 contained in a single slide pack container 42 without manually unpacking the slide pack container 42.

Figure 5:
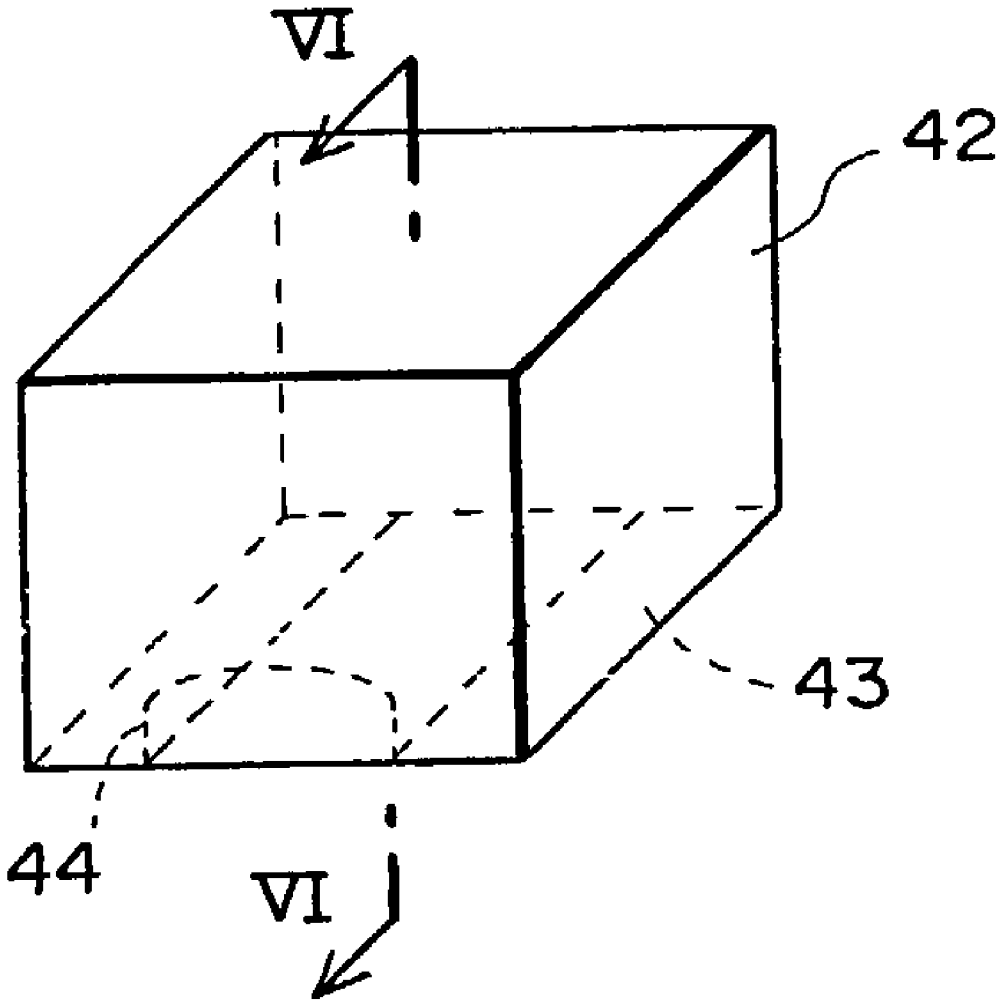
FIG. 5 is a perspective view of a slide pack container.
Figure 6:
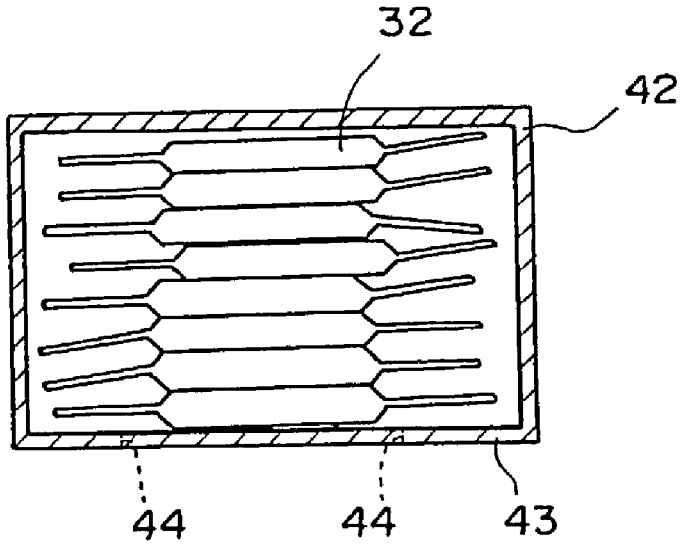
FIG. 6 is a sectional view of the slide pack container along the line VI—VI in FIG. 5.
Figure 7:
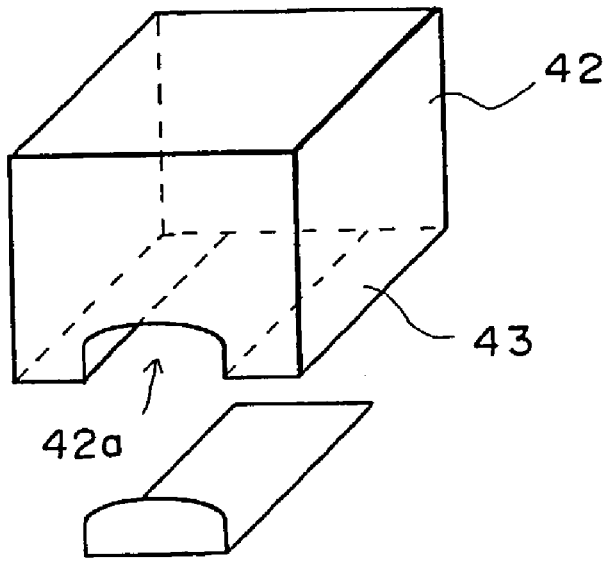
FIG. 7 is another perspective view of the slide pack container in FIG. 5 after a portion thereof is peeled off along a perforation line to form a cut-off portion thereon.

FIG. 5 is a perspective view of the slide pack container 42, which is one embodiment of a package container according to the present invention, and FIG. 6 is a sectional view of the slide pack container 42 along the line VI—VI in FIG. 5. As shown in FIG. 6, the slide pack container 42 houses a plurality of slide packs 32 piled therein. Provided on the bottom face 43 of the slide pack container 42 is a perforation line 44 as shown in FIG. 5. The perforation line 44 is defined so as to form an elongated cut-off portion 42*a* extending in the direction perpendicular to the drawing plane of FIG. 6. The width of the cut-off portion 42*a* is slightly larger than that of the slide 30 contained in the slide pack 32. The examiner is required to place the slide pack container 42 in a desired package cartridge 2 after peeling off a portion of the container 42 along the perforation line 44 to open the cut-off portion 42*a* on the bottom face 43 as shown in FIG. 7.

Again in FIG. 2, a base plate 41 of the housing portion 3 is provided with a plurality of openings (not shown). Positions of the openings on the base plate 41 correspond to the positions of the package cartridges 2. In addition, the cut-off portion 42*a* has already been opened on the bottom face 43 of each slide pack container 42. Therefore, a slide pack 32 can be taken out of each slide pack container 42 housed in any of the package cartridges 2 through the cut-off portion 42*a* and one of the openings on the base plate 41.

Provided under the base plate 41 is a pack taking portion 50 for taking out the slide pack 32 from one of the slide pack containers 42 and transferring the slide pack 32 to the opening 10A of the unwrapping apparatus 10. The pack taking portion 50 includes a sucker 51 for sucking a desired slide pack 32. The sucker 51 is activated by vacuuming means 59 connected thereto. A sucker holding portion 52 carrying the sucker 51 is provided with a screwed bore 52*a*, which is screwed together with a screwed rod 53 extending in the y-direction. Each end of the screwed rod 53 is supported by a supporting portion 54. A pulse motor 55 fixed on the supporting portion 54 revolves the screwed rod 53 to move the sucker holding portion 52 in the y-direction. There are actually two separated supporting portions 54 at both ends of the screwed rod 53, though only one of them appears in FIG. 2.

Each of the supporting portions 54 is provided with another screwed bore 54*a*. The screwed bores 54*a* are screwed together with screwed rods 56A and 56B, respectively. The screwed rods 56A and 56B extend in the x-direction, and are suitably spaced from each other to enable the sucker holding portion 52 to be moved freely under the base plate 41. One end of the screwed rod 56A is supported by a bearing 57A, and the other end is connected to a pulse motor 58A. Similarly, one end of the screwed rod 56B is supported by a bearing 57B, and the other end is connected to a pulse motor 58B. The pulse motors 58A and 58B are controlled so that the screwed rods 56A and 56B are revolved in a synchronized motion. Thus, the sucker holding portion 52 is properly moved in the x-direction. Accordingly, the sucker holding portion 52 can move freely on the x-y plane under the base plate 41.

Figure 8:
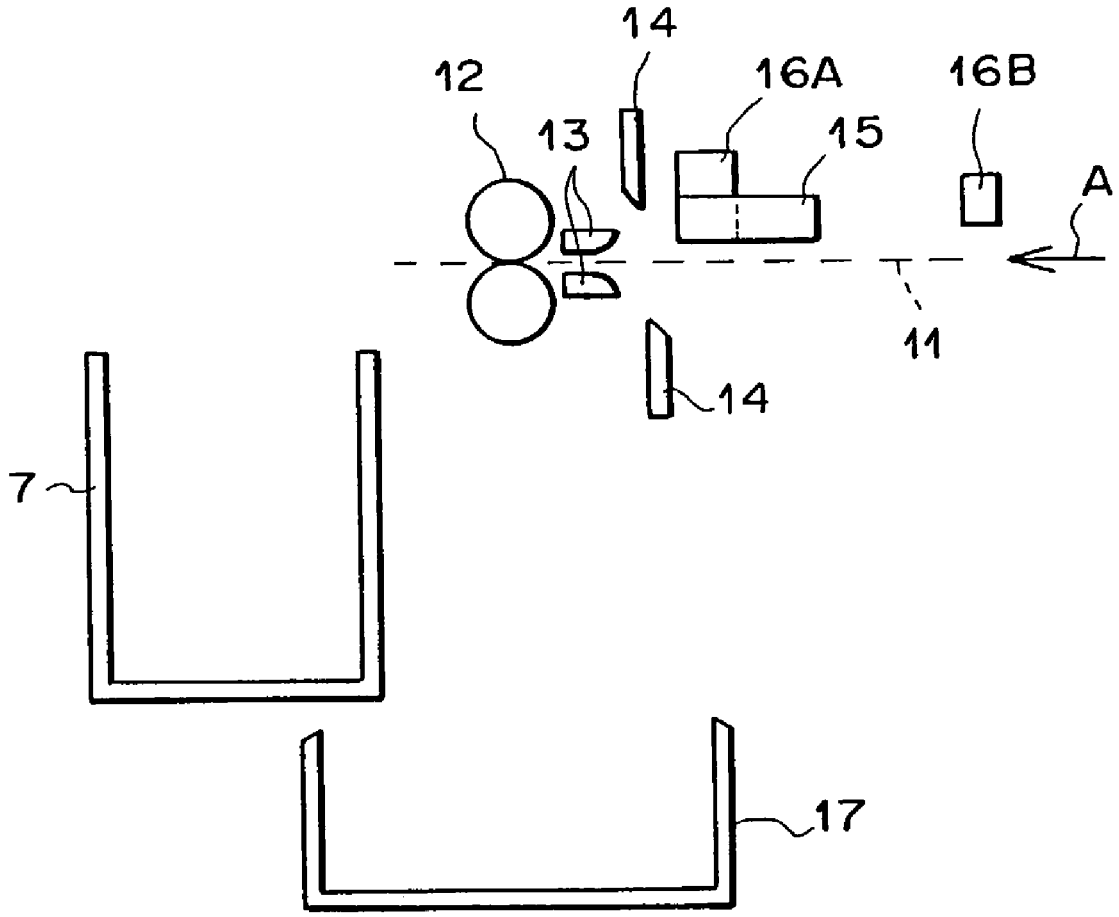
FIG. 8 shows the structure of the unwrapping apparatus according to the first embodiment of the present invention.

FIG. 8 shows the structure of the unwrapping apparatus 10. The unwrapping apparatus 10 includes paired metal rollers 12 (each having a diameter of 10 mm) driven in a synchronized motion. The paired metal rollers 12 are provided on a transferring path 11 for the slide pack 32. The paired metal rollers 12 may be replaced by paired resin rollers, taking into consideration the friction between the rollers and the wrapping sheet 33. The slide pack 32 is first forwarded in the direction of the arrow A. Upper and lower halves of a squeezing member 13, which can be freely inserted into and retracted from the transferring path 11, are provided in front of the paired rollers 12 along the transferring path 11. Provided in front of the squeezing member 13 along the transferring path is a cutter 14. The cutter 14 includes an upper blade and a lower blade each having a width suitable for cutting only a partial width of the wrapping sheet 33. Further, in front of the cutter 14, a guiding plate 15 is provided to guide the upper face of the slide pack 32 along the transferring path 11. The guiding plate 15 is provided with a reflection-type edge detector 16A for detecting the front edge of the slide pack 32. In addition, another reflection-type edge detector 16B is located in front of the guiding plate 15 for detecting the rear edge of the slide pack 32. Located behind the paired rollers 12 and under the transferring path 11 is the cartridge 7 for housing in a desired order a plurality of slides 30 each obtained from a slide pack 32. On the other hand, located under the paired rollers 12 is the disposal bin 17 used for temporarily storing the wrapping sheet 33 removed from the slide 30.

Figure 9A:
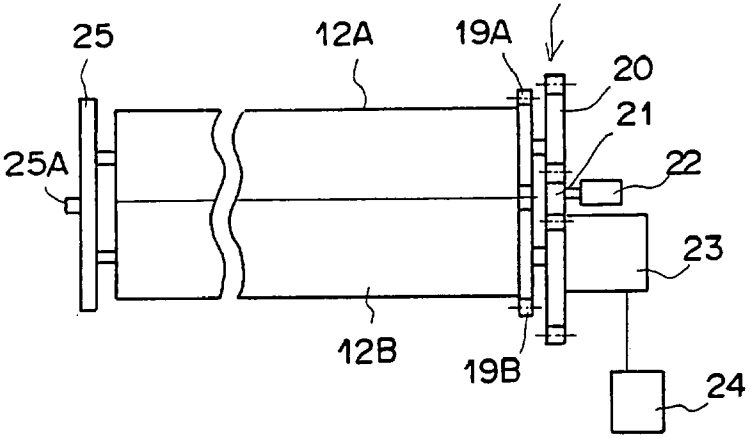
FIGS. 9A to 9C illustrate the structure of a roller unit in the unwrapping apparatus.
Figure 9B:
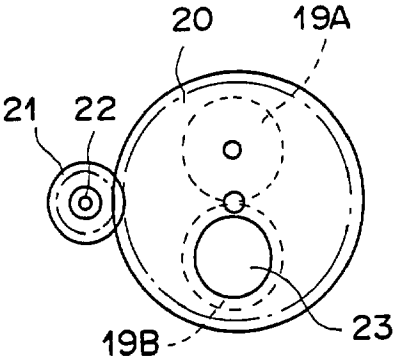
Figure 9C:
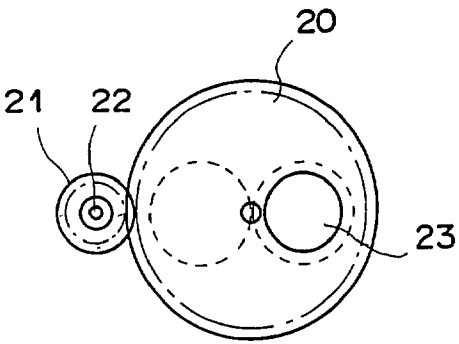

FIGS. 9A, 9B and 9C illustrate the structure of a roller unit 18 for driving and moving the paired rollers 12, wherein FIG. 9A is a plane view, FIG. 9B a side elevation, and FIG. 9C is a figure for illustrating the operation thereof. As shown in FIGS. 9A and 9B, each of the rollers 12A and 12B constituting the paired rollers 12 is respectively provided with a gear 19A or 19B, engaging with each other, at one end thereof. The rotation shafts of the rollers 12A and 12B are supported by another gear 20 and a supporting plate 25. A rotation shaft 25A of the supporting plate 25 is further supported by a supporting mechanism not shown in the figures. The rotation axes of the gear 20 and the supporting plate 25 are identical to the line of contact between the rollers 12A and 12B. The gear 20 and the supporting plate 25, and thus the paired rollers 12, can be rotated by 90° in the counterclockwise direction (i.e., from the state shown in FIG. 9B to the state shown in FIG. 9C) by causing a motor 22 to rotate a gear 21 engaging with the gear 20 in the clockwise direction. On the other hand, a motor 23 fixed to the supporting member 20 is connected to the rotation shaft of the roller 12B. Because of the engagement between the gears 19A and 19B, the rollers 12A and 12B move in a synchronized motion when the motor 23 drives the roller 12B. Connected to the motor 23 is an ammeter 24 for measuring driving current of the motor 23.

Figure 10:
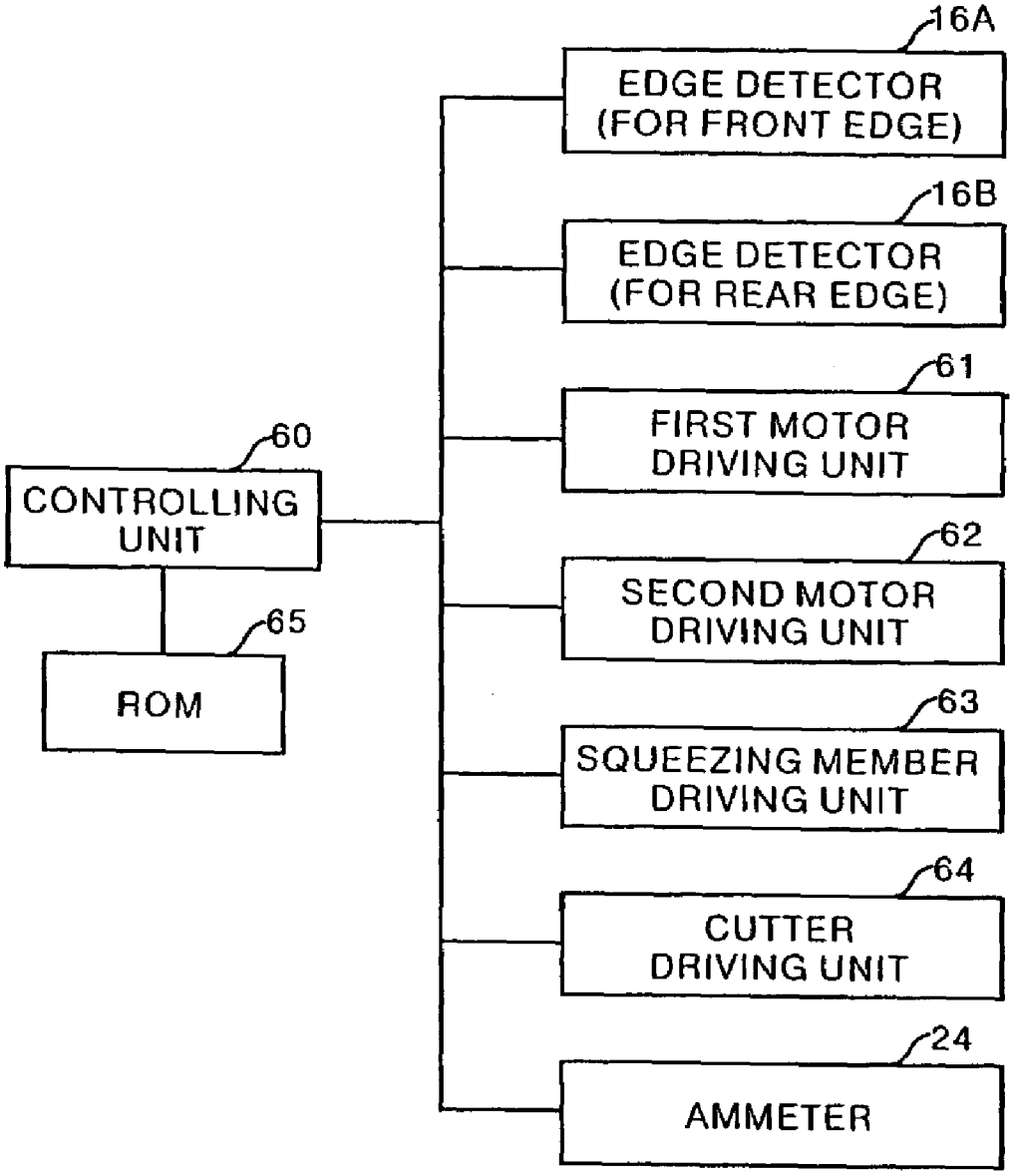
FIG. 10 is a block diagram schematically showing the structure of a controlling unit for controlling the operations of the unwrapping apparatus according to the first embodiment of the present invention.

FIG. 10 is a block diagram schematically showing the structure of a controlling unit 60 for controlling the operations of the unwrapping apparatus 10. As shown in FIG. 10, connected to the controlling unit 60 are the edge detector 16A, a first motor driving unit 61 for driving the motor 23, a second motor driving unit 62 for driving the motor 22, a squeezing member driving unit 63 for driving the squeezing member 13 so as to be inserted into or retracted from the transferring path 11, a cutter driving unit 64 for driving the cutter 14, the ammeter 24, and a ROM 65 containing a program for driving the controlling unit 60 in the manner described below.

Figure 11:
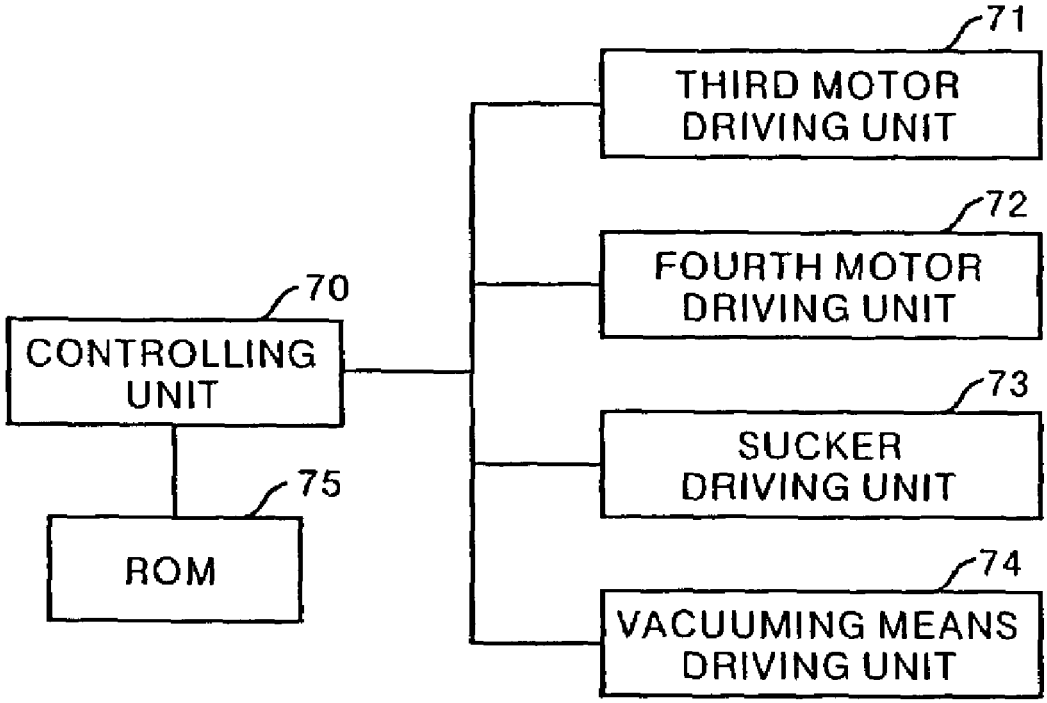
FIG. 11 is a block diagram schematically showing the structure of another controlling unit for controlling the operations of a pack taking portion of the package take-out apparatus according to the first embodiment of the present invention.

FIG. 11 is a block diagram schematically showing the structure of another controlling unit 70 for controlling the operations of the pack taking portion 50. As shown in FIG. 11, connected to the controlling unit 70 are a third motor driving unit 71 for driving the pulse motor 55, a fourth motor driving unit 72 for driving the pulse motors 58A and 58B, a sucker driving unit 73 for driving the sucker holding portion 52 so that the sucker 51 thereon is moved in up and down directions, a vacuuming means driving unit 74 for driving the vacuuming means 59, and a ROM 75 containing a program for driving the controlling unit 70 in the manner described below.

Figure 12:
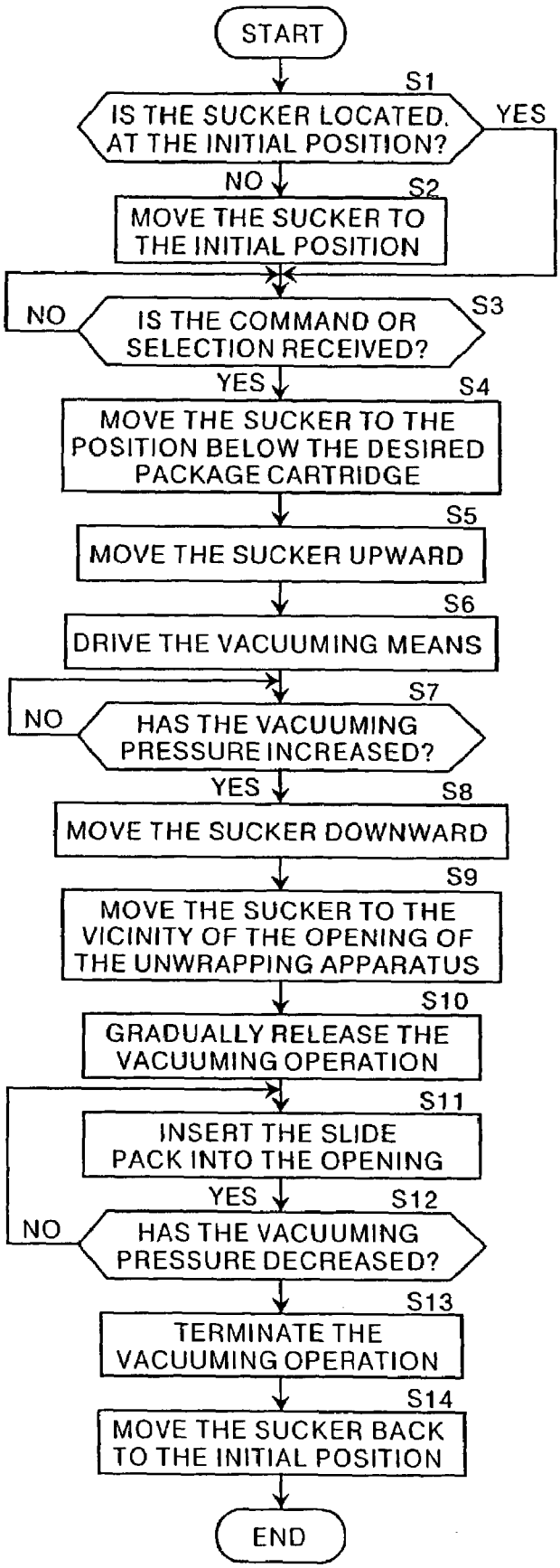
FIG. 12 is a flowchart showing the operation process of the package take-out apparatus according to the first embodiment of the present invention.

Now, the operation of the selective unwrapping apparatus 1 of the present embodiment will be described in detail. FIG. 12 is a flowchart showing the operation process of the selective unwrapping apparatus 1 until the slide pack 32 is transferred to the unwrapping apparatus 10, i.e., the operation process of the package take-out apparatus according to the present embodiment. First of all, whether or not the sucker 51 has been located at a designated initial position thereof is checked (Step 1). If the sucker 51 is not located at the designated initial position, the third and fourth motor driving units 71 and 72 will drive the pulse motors 55, 58A and 58B to move the sucker 51 to the designated initial position (Step 2). In the next step, whether or not the command on selection of the slide packs 32 is received is checked (Step 3). The process proceeds to the next step (Step 4) when an operator inputs a command on desired selection of the slide packs 32 using the command keys 5 at the interface 4. In Step 4, the third and fourth motor driving units 71 and 72 drive the pulse motors 55, 58A and 58B to move the sucker 51 from the initial position thereof to the position below a certain package cartridge 2 where the desired slide pack 32 has been stored. The third and fourth motor driving units 71 and 72 may accomplish Step 4 by, for example, sending pulses to the pulse motors 55, 58A and 58B by the number required for moving the sucker 51 from the initial position thereof to a given coordinate point corresponding to the position of the desired package cartridge 2.

Figure 13:
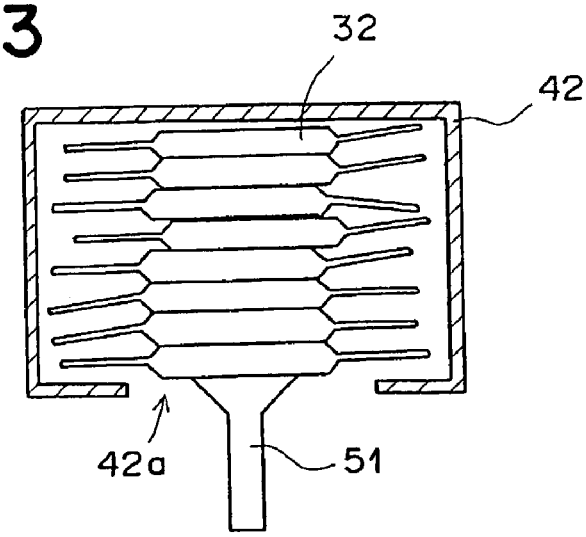
FIG. 13 is a sectional view of the slide pack container showing a sucker sucking one of the slide packs in the slide pack container.

After the sucker 51 reaches the position below the desired package cartridge 2, the sucker driving unit 73 moves the sucker 51 upward (Step 5). Concurrently, the vacuuming means driving unit 74 drives the vacuuming means 59 to activate the sucker 51 (Step 6). In the next step (Step 7), whether or not vacuuming pressure on the vacuuming means 59 has increased is judged. The increase of the vacuuming pressure indicates that the desired slide pack 32 is being sucked by the sucker 51 as shown in FIG. 13. If the increase of the vacuuming pressure is not recognized, the vacuuming operation will be continued. If the increase of the vacuuming pressure is recognized, the sucker driving unit 73 will move the sucker 51 downward to draw the desired slide pack 32 from the slide pack container 42 placed in the package cartridge 2 (Step 8).

Figure 14:
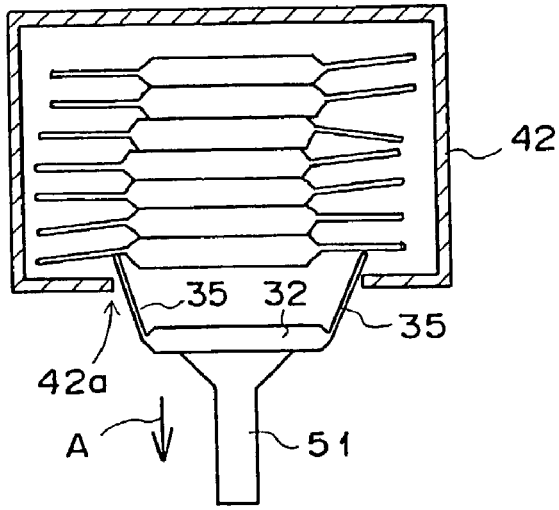
FIG. 14 is a sectional view of the slide pack container while one of the slide packs is being drawn therefrom.
Figure 15:
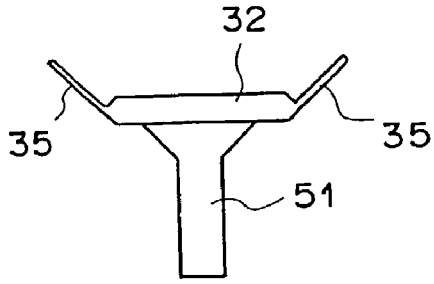
FIG. 15 is a sectional view of the sucker carrying the slide pack taken out of the slide pack container.
Figure 16:
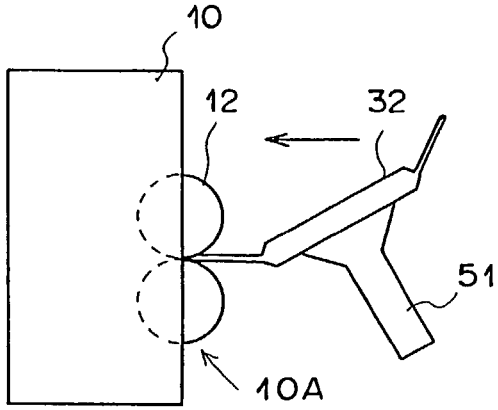
FIG. 16 is a sectional view illustrating how the sucker forwards the slide pack to the paired rollers.

As the width of the cut-off portion 42*a* is only slightly larger than the width of the slide 30, a sealed portion 35 of the slide pack 32 interfering with the edge of the cut-off portion 42*a* is folded in the direction opposite to the direction A as shown in FIG. 14 when the sucker 51 draws the slide pack 32 from the slide pack container 42. Concurrently, the slide 30 moves substantially to the center of the slide pack 32 within an unsealed space 34 thereof.

In the next step (Step 9), the third and fourth motor driving units 71 and 72 drive the pulse motors 55, 58A and 58B to move the sucker 51 to the vicinity of the opening 10A of the unwrapping apparatus 10, while continuing the vacuuming operation for making the sucker 51 suck the slide pack 32 folded at the sealed portion 35 thereof. Then, the vacuuming means driving unit 74 gradually slows down the vacuuming operation (Step 10), and operation of the fourth motor driving unit 72 is terminated. Accordingly, only the third motor driving unit 71 maintains its operation of driving the pulse motor 55 to insert the slide pack 32 into the opening 10A (Step 11). The slide pack 32 is separated from the sucker 51 when the paired rollers 12 in the unwrapping apparatus 10 catch the edge of the slide pack 32 and pull the slide pack 32 into the unwrapping apparatus 10. In the next step (Step 12), whether or not vacuuming pressure on the vacuuming means 59 has decreased to a certain level is judged. The decrease of the vacuuming pressure indicates that the slide pack 32 is now separated from the sucker 51. If the decrease of the vacuuming pressure is not recognized, the operation of inserting the slide pack 32 into the opening 10A will be continued. If the decrease of the vacuuming pressure is recognized, the vacuuming means driving unit 74 completely terminates the vacuuming operation (Step 13) assuming that the slide pack 32 has been successfully forwarded. Finally, to end the process of transferring the slide pack 32 to the unwrapping apparatus 10, the third and fourth motor driving units 71 and 72 drive the pulse motors 55, 58A and 58B to move the sucker 51 back to the designated initial position thereof (Step 14).

Figure 20:
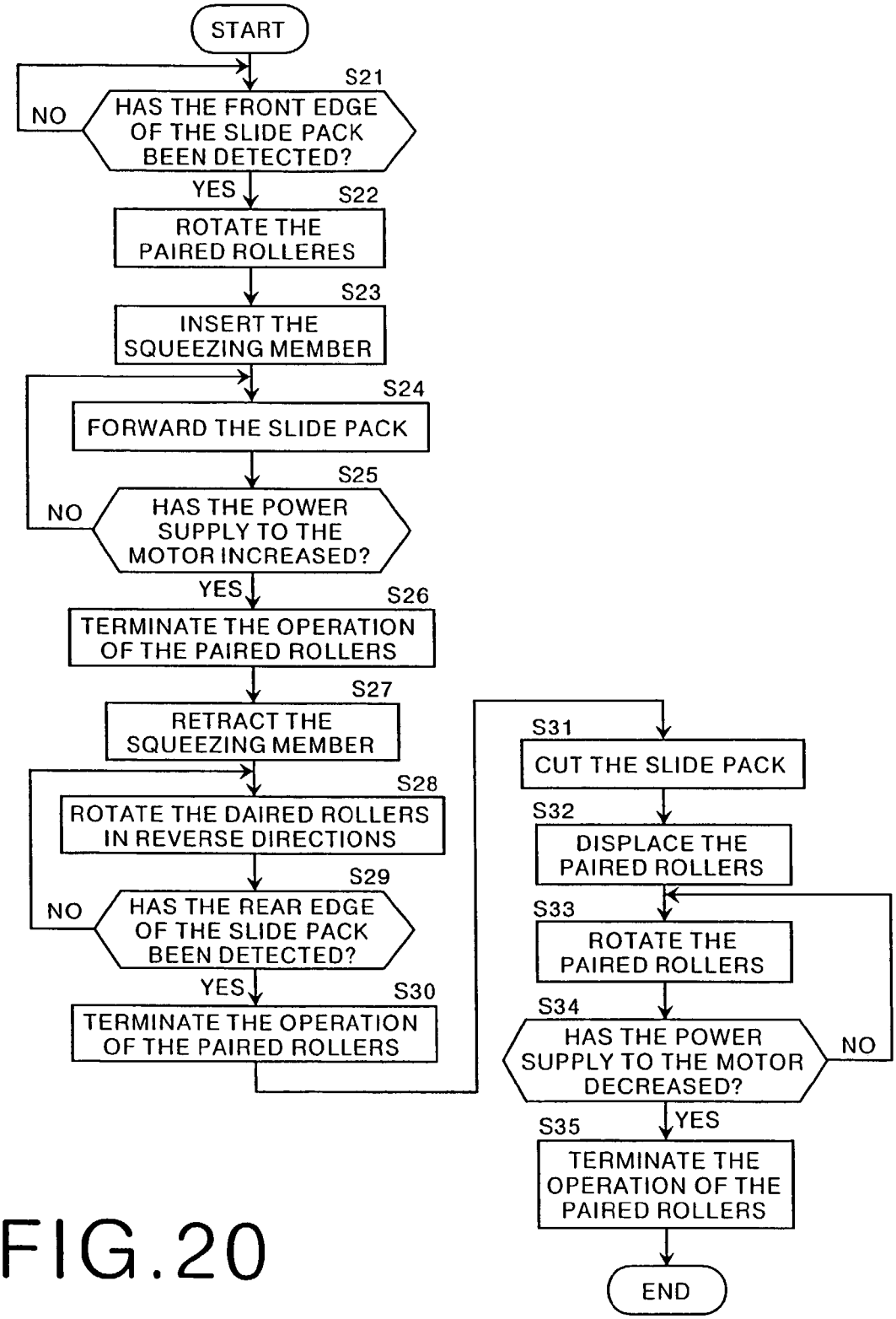
FIG. 20 is a flowchart showing the operation process of the unwrapping apparatus according to the first embodiment of the present invention.
Figure 21:
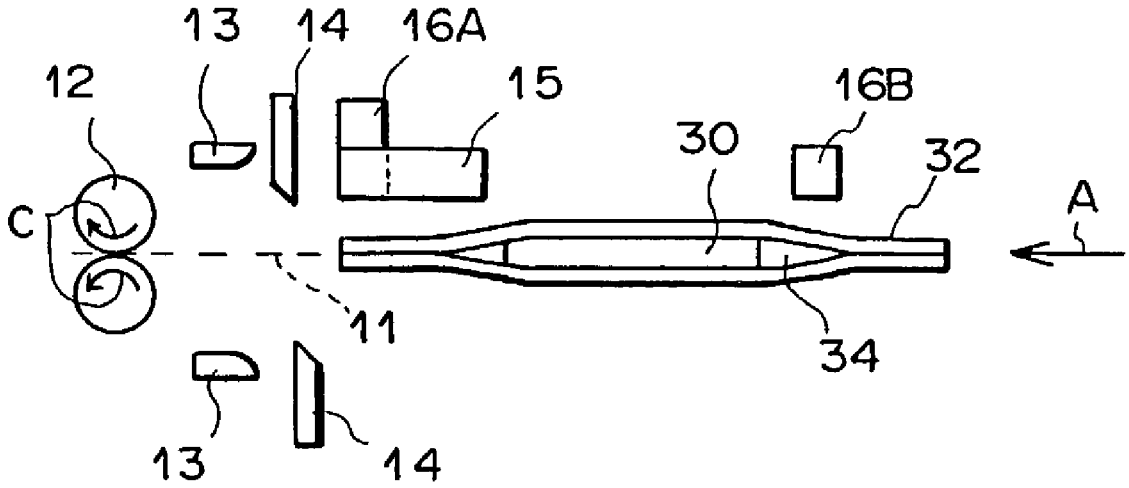
FIG. 21 illustrates a step of the operation process of the unwrapping apparatus according to the first embodiment of the present invention.
Figure 22:
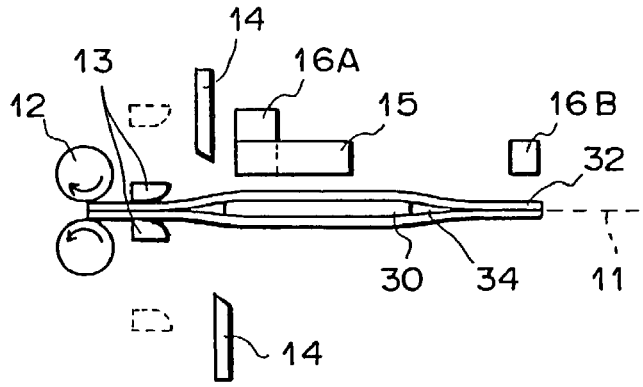
FIG. 22 illustrates another step of the operation process of the unwrapping apparatus according to the first embodiment of the present invention.

FIG. 20 is a flowchart showing the operation process of the unwrapping apparatus 10 according to the present embodiment. The rollers 12A and 12B are assumed to be aligning vertically as shown in FIG. 9B when starting the process of FIG. 20. In addition, the squeezing member 13 is assumed to be in the recessed state with respect to the transferring path 11. First of all, whether or not the edge detector 16A has detected the front edge of the slide pack 32 is checked (Step 21). When the front edge is detected as shown in FIG. 21, the motor driving unit 61 will start driving the motor 23 to rotate the paired rollers 12 in the directions C indicated by arrows in FIG. 21 (Step 22). Concurrently, the squeezing member driving unit 63 inserts the squeezing member 13 into the transferring path 11 (Step 23).

Figure 23:
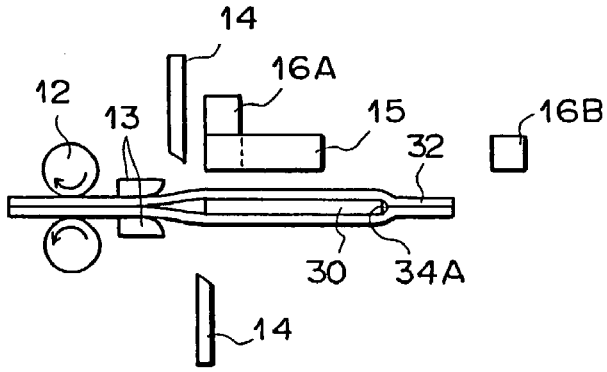
FIG. 23 illustrates still another step of the operation process of the unwrapping apparatus according to the first embodiment of the present invention.

The slide pack 32 is initially forwarded in the direction indicated by an arrow A while being sucked by the sucker 51. The slide pack 32 is released from the sucker 51 when the paired rollers 12 in the unwrapping apparatus 10 catch the front edge of the slide pack 32 and start forwarding the slide pack 32 along the transferring path 11 (Step 24). As the squeezing member 13 has already been inserted into the transferring path 11, the slide 30 in the slide pack 32 is squeezed back within the unsealed space 34 as the paired rollers 12 forward the slide pack 32. Accordingly, as shown in FIG. 23, a wide cut allowance is formed at the front edge of the slide pack 32. When the slide 30 abuts on the rear end 34A of the unsealed space 34, pressure applied to the slide pack 32 by the paired rollers 12 and thus the power supply to the motor 23 for driving the paired rollers 12 will increase, as the slide 30 can no longer be squeezed back within the unsealed space 34. Whether or not the power supply to the motor 23 has increased is checked in Step 25 by monitoring the power supply using the ammeter 24. If the increase of the power supply is detected, the first motor driving unit 61 will terminate the operation of the motor 23 and thus of the paired rollers 12 (Step 26). In addition, the squeezing member driving unit 63 will retract the squeezing member 13 from the transferring path 11 (Step 27). On the other hand, if the increase of the power supply is not detected in Step 25, the forwarding operation of Step 24 will be continued.

Figure 24:
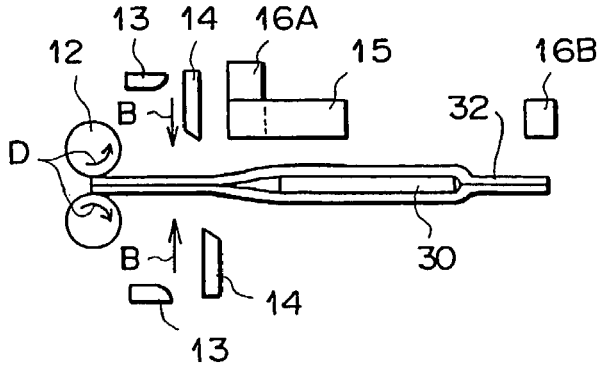
FIG. 24 illustrates still another step of the operation process of the unwrapping apparatus according to the first embodiment of the present invention.

After Step 27, the first motor driving unit 61 drives the motor 23 in the reverse direction to rotate the paired rollers 12 now in the directions indicated by arrows D in FIG. 24 so that the slide pack 32 is transferred backward along the transferring path 11 (Step 28). Then, whether or not the edge detector 16B has detected the rear edge of the slide pack 32 is checked in Step 29. If the rear edge of the slide pack 32 is not detected, the transferring operation of Step 28 will be continued. If the rear edge of the slide pack 32 is detected, the first motor driving unit 61 will terminate the operation of the motor 23 and thus of the paired rollers 12 (Step 30). Then, the cutter 14 driven in the direction indicated by an arrow B by the cutter driving means 64 will cut the slide pack 32 over a partial width thereof (Step 31).

Figure 25:
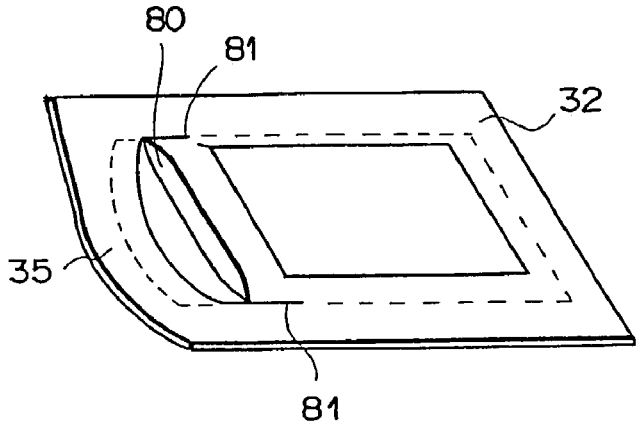
FIG. 25 is a perspective view of a slide pack cut over a partial width thereof.

The position of the edge detector 16B has been determined so that the cutter 14 is aligned with an appropriate position on the unsealed space 34 of the slide pack 32 when the rear edge of the slide pack 32 completely passes below the edge detector 16B. Therefore, the cutter 14 makes a slit 80 on the appropriate position on the unsealed space 34 near the front edge of the slide pack 32 as shown in FIG. 25.

Figure 26:
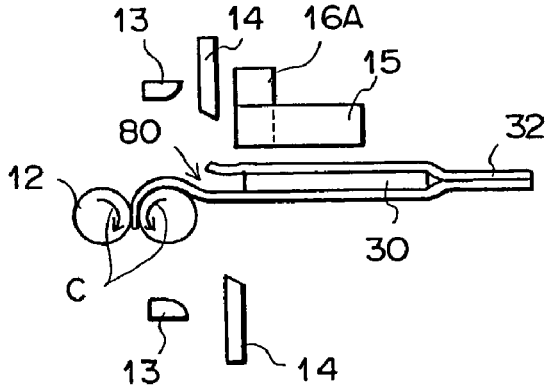
FIG. 26 illustrates still another step of the operation process of the unwrapping apparatus according to the first embodiment of the present invention.
Figure 27:
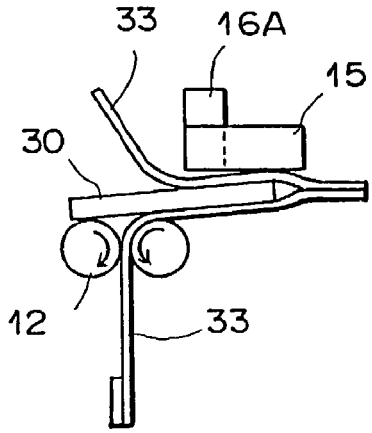
FIG. 27 illustrates still another step of the operation process of the unwrapping apparatus according to the first embodiment of the present invention.

After formation of the slit 80, the second motor driving unit 62 drives the motor 22 to rotate the gear 20 by 90° in the counterclockwise direction (i.e., from the state shown in FIG. 9B to the state shown in FIG. 9C) so that the paired rollers 12 are displaced as shown in FIG. 26 (Step 32). Then, the first motor driving unit 61 drives the motor 23 to rotate the paired rollers 12 in the directions indicated by arrows C in FIG. 26 (Step 33). As the slide 30 in the slide pack 32 is too thick and rigid to be caught between the displaced paired rollers 12, only a portion of the wrapping sheet 33 connected with the front-edge sealed portion 35 is transferred between the paired rollers 12 forming splits 81 on the slide pack 32 as shown in FIG. 25. As the portion of the wrapping sheet 33 is transferred downward by the paired rollers 12, the splits 81 become longer. Finally, the slide 30 in the slide pack 32 is forwarded out from the slit 80 as shown in FIG. 27. The guide plate 15 prevents the slide pack 32 from deflecting upward from the transferring path 11 while the paired rollers 12 pulls the portion of the wrapping sheet 33 downward.

Figure 28:
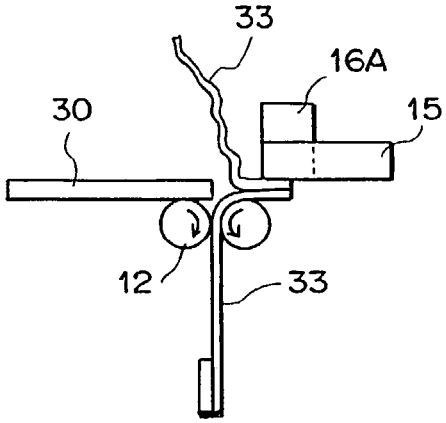
FIG. 28 illustrates still another step of the operation process of the unwrapping apparatus according to the first embodiment of the present invention.
Figure 29:
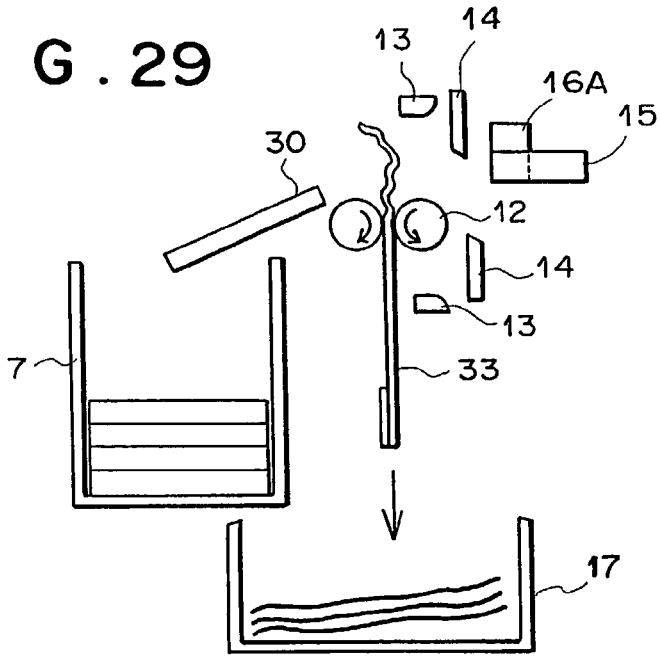
FIG. 29 illustrates another mechanism for terminating the operation of the paired rollers.

After further rotation of the paired rollers 12, the slide 30 will be completely separated from the wrapping sheet 33 as shown in FIG. 28. As shown in FIG. 29, the slide 30 will be housed in order in the cartridge 7 together with several other slides, and the wrapping sheet 33 will be temporarily stored in the disposal bin 17.

When the wrapping sheet 33 separated from the slide 30 is discarded into the disposal bin 17, the pressure applied by the paired rollers 12 and thus the power supply to the motor 23 will decrease. Therefore, when the decrease of the power supply to the motor 23 is detected in Step 34, the first motor driving unit 61 will terminate the operation of the motor 23 and thus the operation of the paired rollers 12 (Step 35) to end the entire operation shown in FIG. 20.

As described so far, the slide pack 32 can be automatically unwrapped to separate the slide 30 therein from the wrapping sheet 33 by using the unwrapping apparatus according to the present embodiment. In addition, as the slide pack 32 is cut over only a partial width thereof as shown in FIG. 25, the wrapping sheet 33 can keep the united form which is easy to handle, even after the cutting process. What makes the handling of the wrapping sheet 33 still easier is the reduced bulk thereof, realized by the paired rollers 12 which transfer the separated wrapping sheet 33 while pressing it.

In addition, the automated selective unwrapping apparatus according to the present embodiment saves the examiner effort of unwrapping each slide pack one by one in a manual manner. As the command on selection can be send at the interface 4 to choose one of a plurality of slide pack containers 42 separately housed in the respective package cartridges 2, the examiner may take each desired slide pack 32 one by one out of a desired slide pack container 42 when collecting a plurality of slide packs 32 for analysis.

Further, as the slide pack 32 taken out of the slide pack container 42 has been folded at the sealed portion 35 thereof keeping the slide 30 substantially at the center of the unsealed portion 34 thereof, the paired rollers 12 may easily catch the sealed portion 35.

In addition, according to the present embodiment, the width of the cut-off portion 42*a* of the slide pack container 42 is only slightly larger than the width of the slide 30. Therefore, the slide pack 30 never falls out from the cut-off portion 42*a* without being folded as described above, making carrying and handling of the slide pack container 42 easier. Further, the above structure of the slide pack container 42 having the perforation line 44 makes carrying and handling of the slide pack container 42 still easier, as the cut-off portion 42*a* is not opened until the examiner peels off a portion of the container 42 along the perforation line 44.

In addition, efficiency of the entire operation is improved as the selective unwrapping apparatus according to the present embodiment is capable of sequentially taking out and unwrapping the slide pack 32.

Although the squeezing member 13 is utilized in the above embodiment to squeeze the slide 30 backward within the unsealed space 34 in the slide pack 32, the function of the squeezing member 13 may be incorporated into the paired rollers 12.

Figure 30:
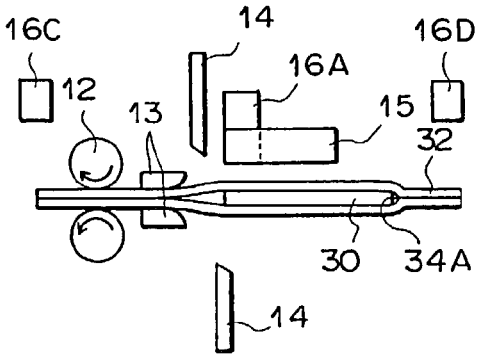
FIG. 30 illustrates another form of the squeezing operation.

Further, although whether or not the slide 30 in the slide pack 32 has abutted on the rear end 34A of the unsealed space 34 is determined by detecting the increase of the power supply to the motor 23 in Step 25 in the above embodiment, it may be determined instead by detecting the front edge of the slide pack 32 using a reflection-type edge detector 16C provided at a predetermined position behind the paired rollers 12 along the transferring path 11 as shown in FIG. 30. Instead, a reflection-type edge detector 16D for detecting the rear edge of the slide pack 32 may be provided as shown in FIG. 30. In the latter case, abutment of the slide 30 on the rear end 34A of the unsealed space 34 is recognized when the rear edge of the slide pack 32 completely passes below the edge detector 16D. The positions of the edge detectors 16C and 16D are determined so that the front edge and the rear edge of the slide pack 32 are aligned with their respective positions when the slide pack 32 is completely squeezed back by the squeezing member 13.

In addition, although the sealed portion 35 in the above embodiment has a predetermined width on all of the four sides of the wrapping sheet 33 as shown in FIGS. 4A and 4B, only the very edges of the wrapping sheet 33 may sufficiently form the sealed portion 35. Otherwise, the wrapping sheet 33 may have a bag-like form, i.e., a form having three of the four side sealed only on edges, so that a sealed portion 35 having a predetermined width is formed on only one side after inserting the slide 30 into the bag-like wrapping sheet 33.

Further, although the cut-off portion 42*a* is located on the bottom face of the slide pack container 42 in the above embodiment, it may instead be provided on the top face of the slide pack container 42 so that the slide packs 32 therein is taken out in the top-to-bottom order.

In addition, although the paired rollers 12 are activated after the edge detector 16A detects the front edge of the slide pack 32 in the above embodiment, the paired rollers 12 may be in the active state throughout the process requiring no edge detector.

Further, although the vacuuming operation of the vacuuming means 59 is terminated when the decrease of the vacuuming pressure is detected in the above embodiment, it may instead be terminated by checking whether or not the front edge of the slide pack 32 is caught between the paired rollers 12.

In addition, the cut-off portion 42*a* may be opened in advance on the slide pack container 42, instead of providing the perforation line 44 to let the examiner open the cut-off portion 42*a*.

Figure 17:
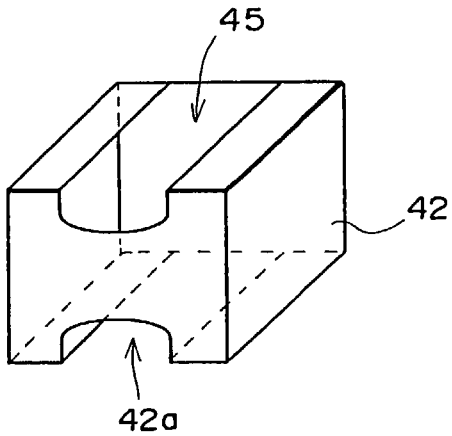
FIG. 17 is a perspective view showing another embodiment of the slide pack container.
Figure 18:
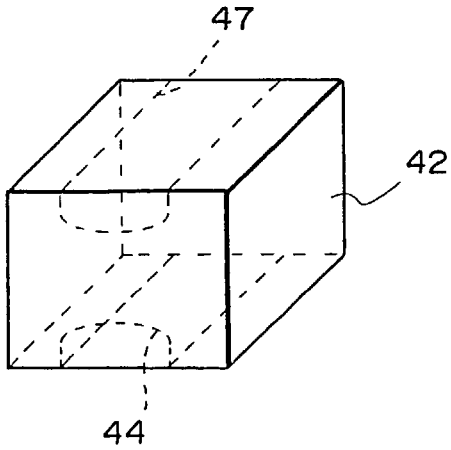
FIG. 18 is a perspective view showing still another embodiment of the slide pack container.

Further, another cut-off portion 45 having a form symmetrical to the cut-off portion 42*a* may be formed on the top face of the slide pack container 42 as shown in FIG. 17. The additional cut-off portion 45 enables the examiner to observe the internal area of the slide pack container 42*a* to visually check the approximate rest number of the slide packs 32 contained therein. It is preferable that the cut-off portion 45 is opened in the similar manner as the cut-off portion 42*a* by letting the examiner to peel off a portion of the slide pack container 42 along another perforation line 47 as shown in FIG. 18.

Figure 19:
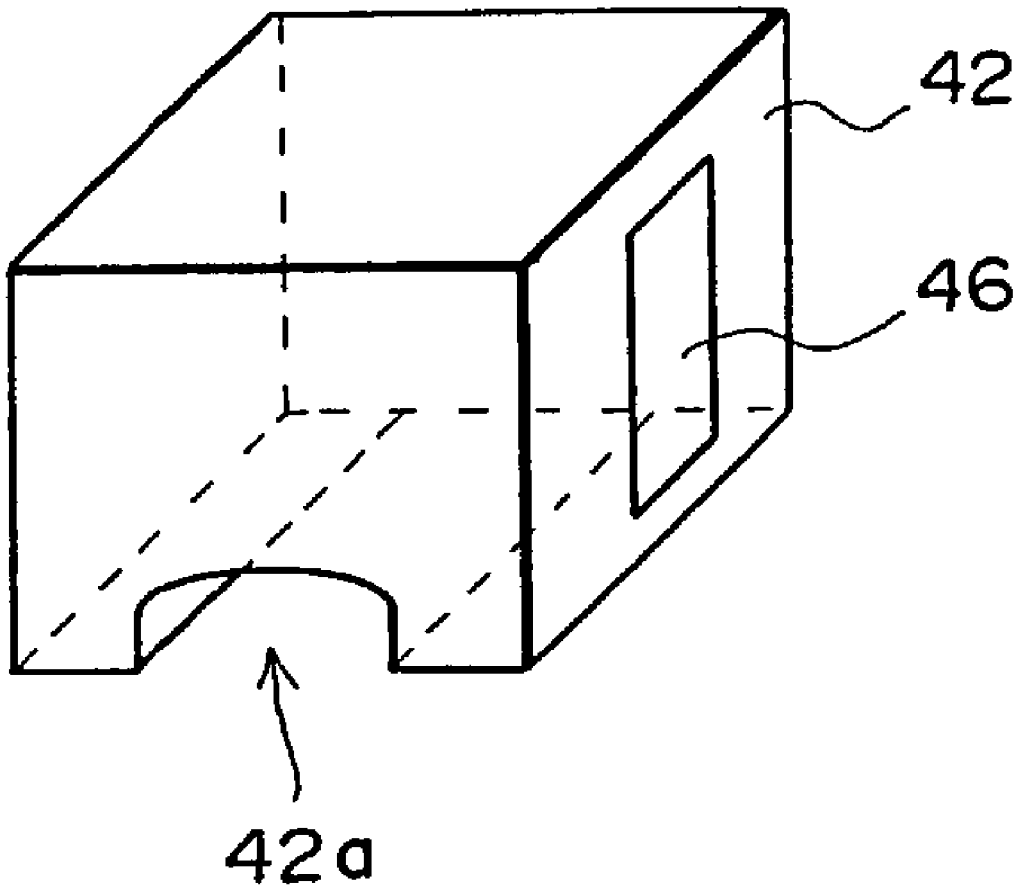
FIG. 19 is a perspective view showing still another embodiment of the slide pack container.

In addition, another cut-off portion 46 may be formed on one side of the slide pack container 42 as shown in FIG. 19 to further facilitate the check of the rest number of the slide packs 32 contained in the slide pack container 42. The cut-off portion 46 may be replaced by a transparent window.

Further, although the slide pack container 42 containing a plurality of slide packs 32 is directly placed in the package cartridge 2 in the above embodiment, the slide packs 32 may instead be piled and housed in the package cartridge 2 after manually unpacking the slide pack container 42. In that case, each opening corresponding to each package cartridge 2 is required to have a width slightly larger than that of the slide 30 so that the slide pack 32 is taken out in the same manner as described above through the opening by the sucker 51.

In addition, although the cut allowance is formed by squeezing the slide 30 in the slide pack 32 back to the rear end 34A of the unsealed space 34 in Steps 22 to 25 in the above embodiment, the slide pack 32 may be cut by the cutter 14 without going through Steps 22 to 25 in the case where the unsealed space 34 has a sufficient margin or where the slide 30 has been offset in advance toward the rear end 34A.

Figure 31:
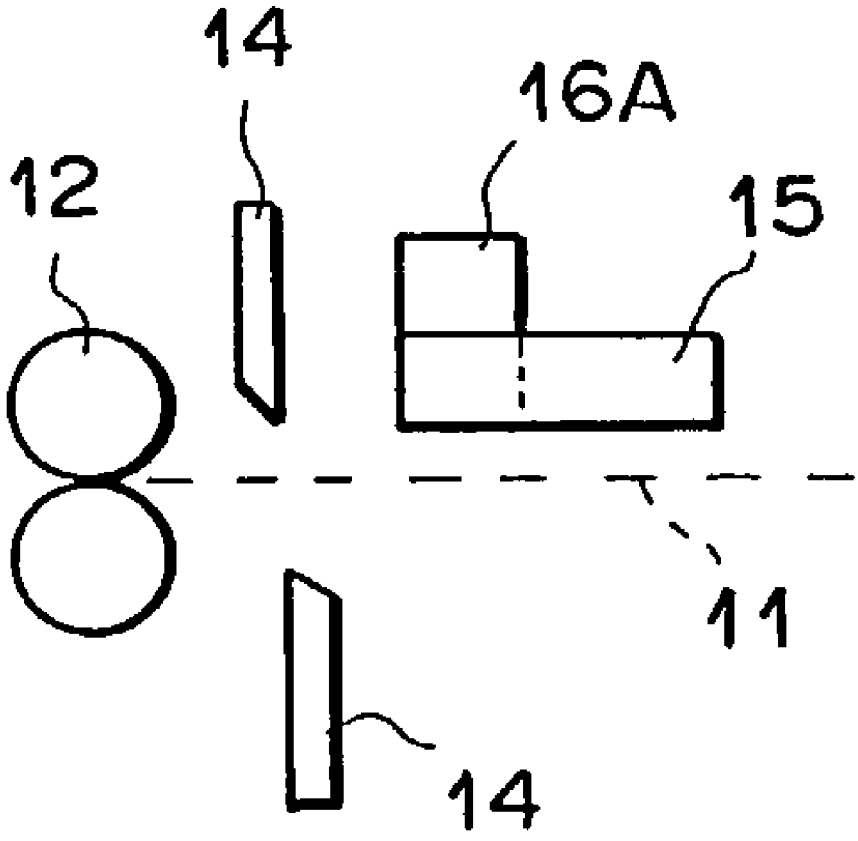
FIG. 31 shows the structure of an unwrapping apparatus according to the second embodiment of the present invention.

Now, the second embodiment of the present invention employing no squeezing member will be described. FIG. 31 illustrates the structure of an unwrapping apparatus according to the second embodiment of the present invention. Each component in FIG. 31 functions in the same way as the corresponding component having the same reference number in FIG. 8. As is clear from FIG. 31, the unwrapping apparatus according to the present embodiment comprises paired rollers 12, a cutter 14, a guiding plate 15 and an edge detector 16A.

Figure 32:
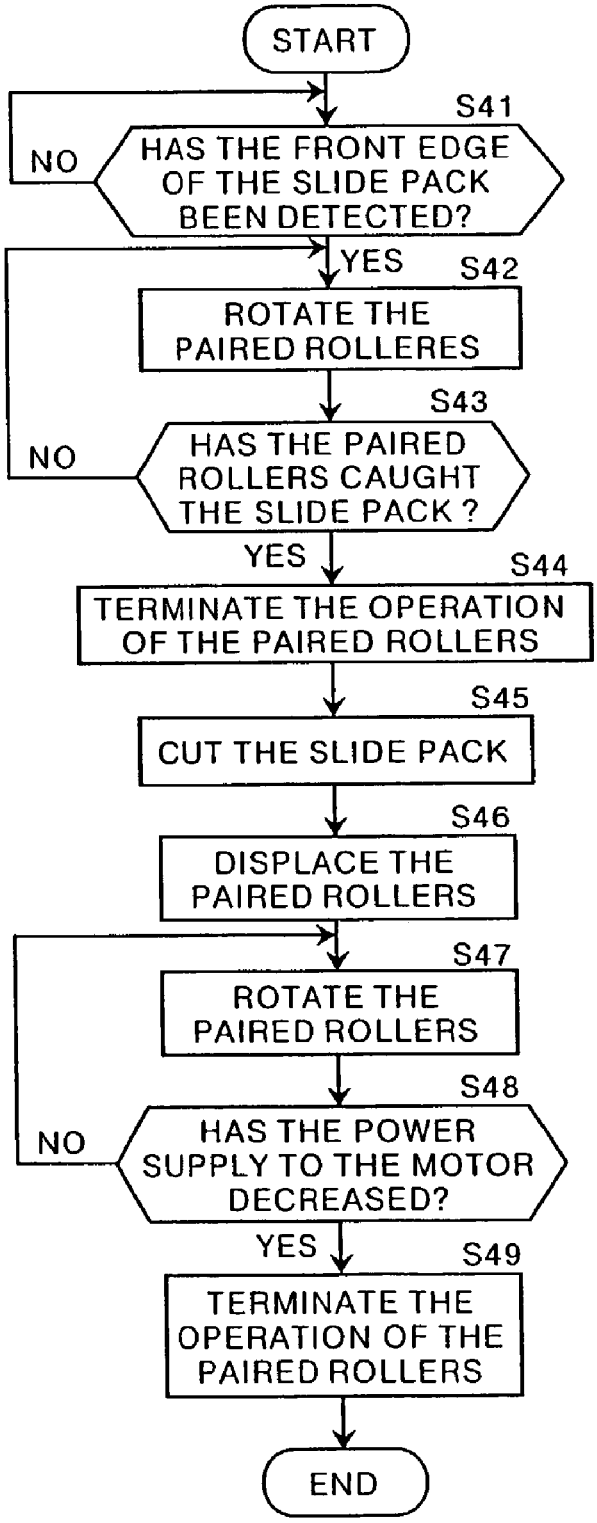
FIG. 32 is a flowchart showing the operation process of the unwrapping apparatus according to the second embodiment of the present invention.

Now, the operation process of the unwrapping apparatus of the present embodiment will be described in detail with reference to a flowchart shown in FIG. 32. It is assumed that the paired rollers 12 are initially in the vertically-aligned state as shown in FIG. 9B. First of all, whether or not the edge detector 16A has detected the front edge of a slide pack 32 is checked (Step 41). When the front edge is detected by the edge detector 16A, a first motor driving unit 61 drives a motor 23 to rotate the paired rollers 12 in the same manner as the first embodiment (Step 42).

The slide pack 32 is transferred to the unwrapping apparatus shown in FIG. 31 by a sucker 51. The sucker 51 releases the slide pack 32 when the paired rollers 12 catch the front edge of the slide pack 32. When the paired rollers 12 catch the front edge of the slide pack 32, pressure applied by the paired rollers 12 and thus the power supply to the motor 23 driving the paired rollers 12 will increase. Whether or not the paired rollers 12 have caught the front edge of the slide pack 32, i.e., whether or not the power supply to the motor 23 has increased, is checked in Step 43 in FIG. 32 by monitoring the power supply using an ammeter 24. Otherwise, whether or not the paired rollers 12 have caught the front edge of the slide pack 32 may be checked using a separated edge detector provided so as to detect the rear edge of the slide pack 32. After Step 43, the operation of the paired rollers 12 is suspended in Step 44.

Figure 33:
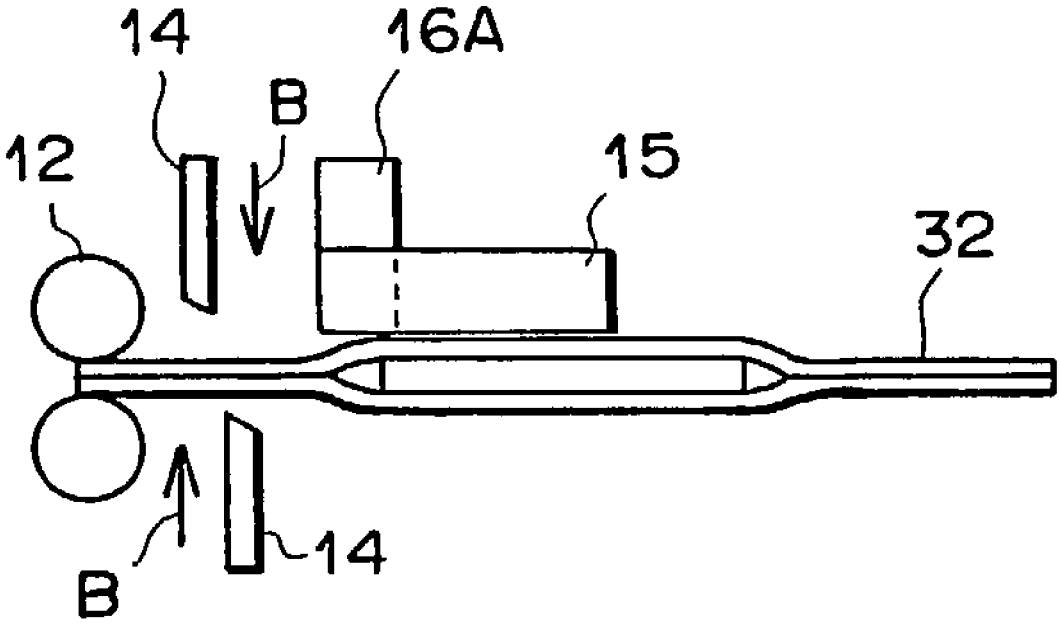
FIG. 33 illustrates a step of the operation process of the unwrapping apparatus according to the second embodiment of the present invention.

In the next step, a partial width of the slide pack 32 is cut by the cutter 14 driven by cutter driving means 64 in the directions indicated by arrows B in FIG. 33 (Step 45). Accordingly, a slit 80 is formed. Then, Steps 46 to 49, which are identical to Steps 32 to 35 in FIG. 20, are carried out to separate the slide 30 from the wrapping sheet 33.

Although both the first and second embodiments described above relate to a package take-out apparatus and an unwrapping apparatus for handling the slide pack 32 containing the slide 30 for chemical analysis, the present invention is applicable to any kind of package containing a solid object wrapped with a wrapping sheet.

What is claimed is:

1. An unwrapping apparatus for unwrapping a package containing a solid object tightly wrapped with a wrapping sheet, said package including an unsealed space where the solid object is contained and a sealed portion surrounding the unsealed space, comprising paired rollers rotatable so that the package caught between the paired rollers is transferred along a predetermined transferring path, displacing means for displacing the paired rollers so that the wrapping sheet of the package caught between the paired rollers is transferred along another path different from said predetermined transferring path, a cutter located in front of the paired rollers along the predetermined transferring path for making a slit on the unsealed space at a position near the front edge of the package, and controlling means for controlling operations of the paired rollers, the displacing means and the cutter by rotating the paired rollers in respective predetermined directions, suspending rotation of the paired rollers when the front edge of the package is caught between the paired rollers, causing the cutter to make the slit on the package, causing the displacing means to displace the paired rollers, and rotating the paired rollers in said predetermined directions so that only the wrapping sheet separated from the solid object is transferred along said another path different from said predetermined transferring path.

2. An unwrapping apparatus according to claim 1, further comprising shift detecting means for recognizing that the solid object has been sufficiently squeezed back to the rear end of the unsealed space in the package, wherein the controlling means further controls operations of the paired rollers and the shift detecting means by rotating the paired rollers in the predetermined directions, letting the paired rollers forward the package along the predetermined transferring path until the shift detecting means recognizes that the solid object has been sufficiently squeezed back to the rear end of the unsealed space, rotating the paired rollers in the directions reverse to said predetermined directions to transfer back the package, and suspending rotation of the paired rollers when the front edge of the package is caught between the paired rollers.

3. An unwrapping apparatus according to claim 2, further comprising a squeezing member located in front of the paired rollers along the predetermined transferring path in such a manner that the squeezing member can be freely inserted into and retracted from the predetermined transferring path, wherein the controlling means further controls operations of the squeezing member by inserting the squeezing member into the predetermined transferring path before forwarding the package along the predetermined transferring path, and retracting the squeezing member from the predetermined transferring path when the shift detecting means recognizes that the solid object has been sufficiently squeezed back to the rear end of the unsealed space in the package.

4. An unwrapping apparatus according to claim 3, further comprising edge detecting means for detecting the front edge of the package located in front of the paired rollers along the predetermined transferring path, wherein the controlling means further controls operations of the paired rollers by causing the paired rollers to begin the rotation in said predetermined directions after the front edge of the package is detected by the edge detecting means.

5. An unwrapping apparatus according to claim 2, further comprising edge detecting means for detecting the front edge of the package located in front of the paired rollers along the predetermined transferring path, wherein the controlling means further controls operations of the paired rollers by causing the paired rollers to begin the rotation in said predetermined directions after the front edge of the package is detected by the edge detecting means.

6. An unwrapping apparatus according to claim 1, further comprising edge detecting means for detecting the front edge of the package located in front of the paired rollers along the predetermined transferring path, wherein the controlling means further controls operations of the paired rollers by causing the paired rollers to begin the rotation in said predetermined directions after the front edge of the package is detected by the edge detecting means.

7. An unwrapping apparatus according to claim 1, further comprising an object cartridge used for housing the solid object after being separated from the wrapping sheet and being located behind the paired rollers along the predetermined transferring path.

8. An unwrapping apparatus according to claim 7, further comprising a disposal bin used for temporarily storing the wrapping sheet removed from the solid object and being located below an end of said another path.

9. An unwrapping apparatus according to claim 1, further comprising a disposal bin used for temporarily storing the wrapping sheet removed from the solid object and being located below an end of said another path.

* * * * *